US006170908B1

(12) United States Patent
Jewell

(10) Patent No.: US 6,170,908 B1
(45) Date of Patent: Jan. 9, 2001

(54) CONVERTIBLE FOOT STOOL

(76) Inventor: Richard Owen Jewell, 450 Ventanas Ave., Oakdale, CA (US) 95361

( * ) Notice: Under 35 U.S.C. 154(b), the term of this patent shall be extended for 0 days.

(21) Appl. No.: 09/407,250

(22) Filed: Sep. 28, 1999

(51) Int. Cl.[7] ..... A47C 13/00
(52) U.S. Cl. ..... 297/118; 5/633; 297/423.41
(58) Field of Search ..... 297/118, 125, 297/452.11, 423.41; 5/630, 632, 633, 653, 656, 657

(56) References Cited

U.S. PATENT DOCUMENTS

| | | | | |
|---|---|---|---|---|
| D. 349,194 | | 8/1994 | Hollis | D6/368 |
| 2,593,319 | * | 4/1952 | Levitin et al. | 5/633 X |
| 3,469,882 | * | 9/1969 | Larsen | 297/118 |
| 3,680,917 | * | 8/1972 | Harris | 297/452.41 |
| 3,775,785 | * | 12/1973 | Mittendorf | 5/640 |
| 4,635,306 | * | 1/1987 | Willey | 5/657 X |
| 4,970,742 | * | 11/1990 | Keener | 5/633 |
| 5,069,503 | | 12/1991 | Martinez | 297/54 |
| 5,244,250 | | 9/1993 | Nordmeyer | 297/59 |
| 5,244,255 | | 9/1993 | Hill | 297/423.41 |
| 5,382,081 | | 1/1995 | Henry | 297/440 |
| 5,385,390 | | 1/1995 | Freeman et al. | 297/380 |
| 5,432,967 | * | 7/1995 | Raftery | 5/644 X |

* cited by examiner

*Primary Examiner*—Peter M. Cuomo
*Assistant Examiner*—Stephen Vu
(74) *Attorney, Agent, or Firm*—Goldstein & Canino

(57) ABSTRACT

A convertible foot stool including a pair of triangular padded sections hingedly coupled together for forming a footstool in a first orientation, a chair in a second orientation, and a recliner in a third orientation.

2 Claims, 1 Drawing Sheet

CONVERTIBLE FOOT STOOL

BACKGROUND OF THE INVENTION

The present invention relates to a convertible foot stool and more particularly pertains to allowing a foot stool to be converted into a chair.

Typically, when people are gathered in someone's home, there is a tendency to run out of seats for all who are gathered. Thus, someone is forced to sit on an ottoman or footstool. Unfortunately, these makeshift seats tend to be uncomfortable for the user when seated for an extended period of time due to the lack of a backrest to provide support to the user's back. What is needed is a footstool that will convert into a more comfortable chair for people to use for extended periods without resulting in discomfort.

The present invention attempts to solve the abovementioned problem by providing a footstool that is comprised of two triangular sections that are hingedly coupled together so they can be unfolded with respect to one another in order to form a chair or, alternately, form a type of recliner, to allow a person to comfortably sit for an extended period of time.

The use of portable folding seats is known in the prior art. More specifically, portable folding seats heretofore devised and utilized for the purpose of allowing a seat to be folded for easy transportation are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,244,250 to Nordmeyer discloses a portable fold-up sports chair designed for sport, recreational, or beach use. U.S. Pat. No. 5,382,081 to Henry discloses a foldable, portable seat structure that is manufactured from preformed blanks of sheet material. U.S. Pat. No. Des. 349,194 to Hollis discloses an ornamental design for a folding portable stadium seat. U.S. Pat. No. 5,385,390 to Freeman et al. discloses a portable seat carrier. U.S. Pat. No. 5,244,255 to Hill discloses a folding footrest that folds into compact form for carrying about in a pocket or purse. U.S. Pat. No. 5,069,503 to Martinez discloses a portable, collapsible multi-purpose chair which is collapsible into a portable configuration of a generally rectangular box-like shape.

While these devices fulfill their respective, particular objective and requirements, the aforementioned patents do not describe a convertible foot stool for allowing a foot stool to be converted into a chair.

In this respect, the convertible foot stool according to the present invention substantially departs from the conventional concepts and designs of the prior art, and in doing so provides an apparatus primarily developed for the purpose of allowing a foot stool to be converted into a chair.

Therefore, it can be appreciated that there exists a continuing need for a new and improved convertible foot stool which can be used for allowing a foot stool to be converted into a chair. In this regard, the present invention substantially fulfills this need.

SUMMARY OF THE INVENTION

In the view of the foregoing disadvantages inherent in the known types of portable folding seats now present in the prior art, the present invention provides an improved convertible foot stool. As such, the general purpose of the present invention, which will be described subsequently in greater detail, is to provide a new and improved convertible foot stool and method which has all the advantages of the prior art and none of the disadvantages.

To attain this, the present invention essentially comprises a pair of triangular padded sections hingedly coupled together for forming a footstool in a first orientation, a chair in a second orientation, and a recliner in a third orientation. The triangular padded sections are defined by a first short side, a second long side, and a third longer side. Each of the triangular padded sections is further defined by a ninety degree angle between the first short side and the second long side, a sixty degree angle between the first short side and the third longer side, and a thirty degree angle between the second long side and the third longer side. The thirty degree angle of a first triangular padded section is hingedly coupled with the sixty degree section of a second triangular section.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved convertible foot stool which has all the advantages of the prior art portable folding seats and none of the disadvantages.

It is another object of the present invention to provide a new and improved convertible foot stool which may be easily and efficiently manufactured and marketed.

It is a further object of the present invention to provide a new and improved convertible foot stool which is of durable and reliable construction.

An even further object of the present invention is to provide a new and improved convertible foot stool which is susceptible of a low cost of manufacture with regard to both materials and labor, and which accordingly is then susceptible of low prices of sale to the consuming public, thereby making such a convertible foot stool economically available to the buying public.

Even still another object of the present invention is to provide a new and improved convertible foot stool for allowing a foot stool to be converted into a chair.

Lastly, it is an object of the present invention to provide a new and improved convertible foot stool including a pair forming a footstool in a first orientation, a chair in a second orientation, and a recliner in a third orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 2:
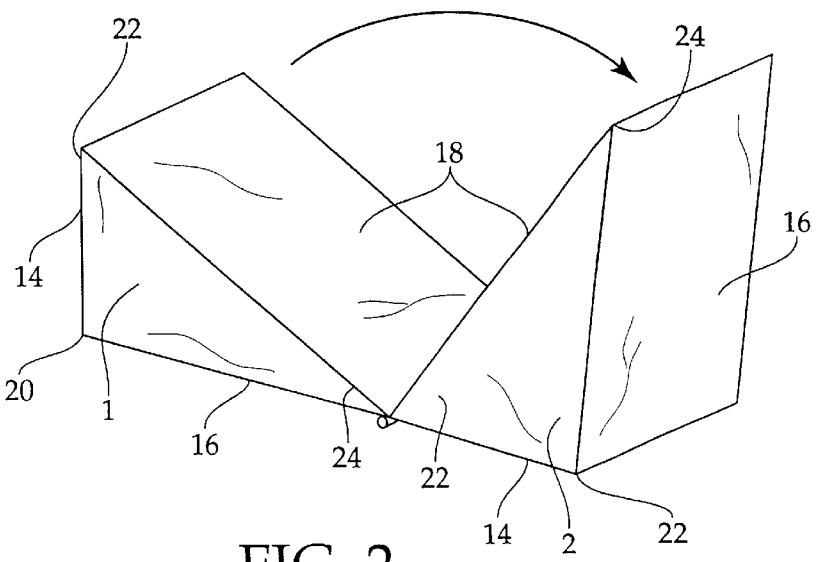
FIG. 2 is a perspective view of the present invention illustrated in a chair orientation.
Figure 1:
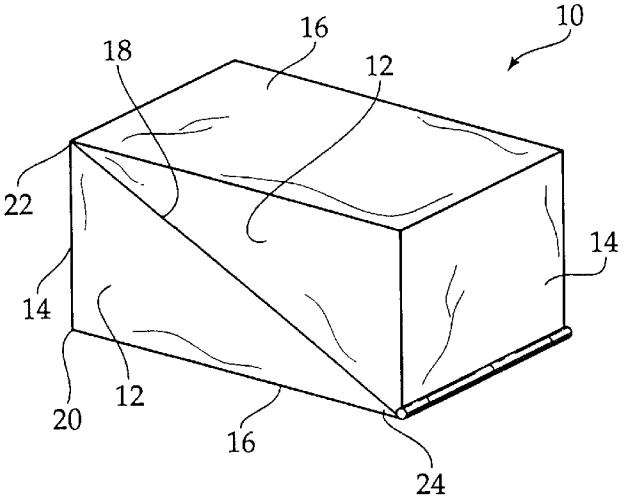
FIG. 1 is a perspective view of the preferred embodiment of the convertible foot stool constructed in accordance with the principles of the present invention.
Figure 3:
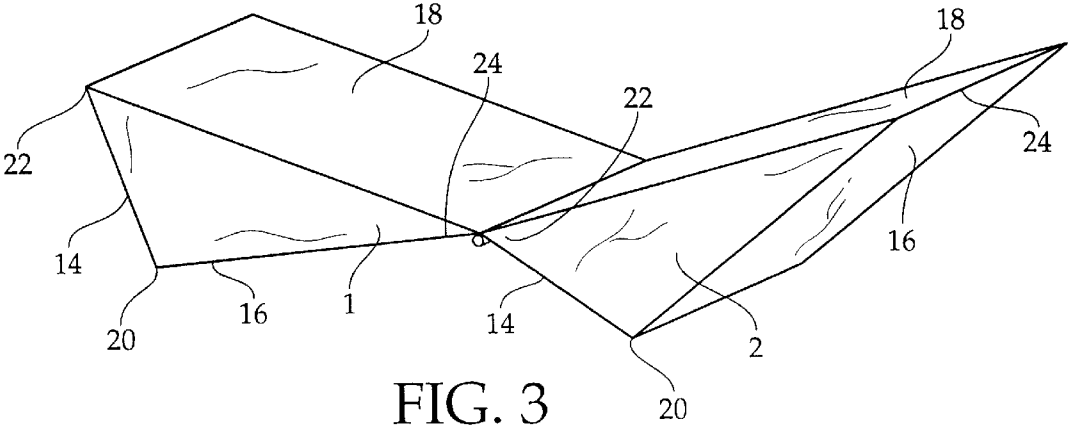
FIG. 3 is a perspective view of the present invention illustrated in a recliner orientation.

With reference now to the drawings, and in particular, to FIGS. 1 through 3 thereof, the preferred embodiment of the new and improved convertible foot stool embodying the principles and concepts of the present invention and generally designated by the reference number 10 will be described.

Specifically, it will be noted in the various Figures that the device relates to a convertible foot stool for allowing a foot stool to be converted into a chair. In its broadest context, the device consists of a pair of triangular padded sections. Such components are individually configured and correlated with respect to each other so as to attain the desired objective.

The pair of triangular padded sections 12 are hingedly coupled together for forming a footstool in a first orientation (FIG. 1), a chair in a second orientation (FIG. 2), and a recliner in a third orientation (FIG. 3). The triangular padded sections 12 are defined by a first short side 14, a second long side 16 wherein the second long side is longer than the first short side, and a third longer side 18 wherein the third longer side is longer than both the first short side and the second long side. Each of the triangular padded sections 12 is further defined by a ninety degree angle 20 between the first short side 14 and the second long side 16, a sixty degree angle 22 between the first short side 14 and the third longer side 18, and a thirty degree angle 24 between the second long side 16 and the third longer side 18. The thirty degree angle 24 of a first triangular padded section 1 is hingedly coupled with the sixty degree section 22 of a second triangular section 2.

Thus, as illustrated in FIG. 1, the third longer sides 18 of the triangular padded sections 12 will lie in a facing relationship to form a generally rectangular shape for use as a foot stool.

FIG. 2 illustrates the second long side 16 of the first triangular padded section 1 abutting a recipient surface with the first short side 14 of the second triangular padded section 2 abutting the recipient surface to form a chair.

FIG. 3 illustrates the ninety degree angles 20 of the pair of triangular padded sections 12 positioned on the recipient surface thereby creating a greater distance between the third longer sides 18 so as to form a recliner.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed is:

1. A convertible foot stool for allowing a foot stool to be converted into a chair, said stool comprising:

a pair of triangular padded sections hingedly coupled together for forming a footstool in a first orientation, a chair in a second orientation, and a recliner in a third orientation, each of said triangular padded sections defined by a first short side, a second long side wherein the second long side is longer than the first short side, and a third longer side wherein the third longer side is longer than both the first short side and the second long side, and further defined by a ninety degree angle between the first short side and the second long side, a sixty degree angle between the first short side and the third longer side, and a thirty degree angle between the second long side and the third longer side.

2. The convertible foot stool as set forth in claim 1 wherein the thirty degree angle of a first triangular padded section is hingedly coupled with the sixty degree section of a second triangular section.

* * * * *